US006390012B1

(12) United States Patent
Watt et al.

(10) Patent No.: US 6,390,012 B1
(45) Date of Patent: May 21, 2002

(54) APPARATUS AND METHOD FOR DEPLOYING, RECOVERING, SERVICING, AND OPERATING AN AUTONOMOUS UNDERWATER VEHICLE

(75) Inventors: Andrew M. Watt, Jupiter; Allen F. Leatt, Tequesta, both of FL (US); Calum MacKinnon, Aberdeen (GB)

(73) Assignee: Coflexip, S.A., Paris (FR)

( * ) Notice: Subject to any disclaimer, the term of this patent is extended or adjusted under 35 U.S.C. 154(b) by 0 days.

(21) Appl. No.: 09/399,519

(22) Filed: Sep. 20, 1999

(51) Int. Cl.[7] ..... B63G 8/41
(52) U.S. Cl. ..... 114/322; 114/51
(58) Field of Search ..... 114/50, 51, 313, 114/322, 337, 312

(56) References Cited

U.S. PATENT DOCUMENTS

| | | | | |
|---|---|---|---|---|
| 3,099,316 A | | 7/1963 | Johnson | |
| 3,348,517 A | * | 10/1967 | Johnson, Jr. et al. | 114/296 |
| 3,367,299 A | * | 2/1968 | Sayre, Jr. | 114/51 |
| 3,779,195 A | * | 12/1973 | Oeland, Jr. | 114/51 |
| 3,987,741 A | * | 10/1976 | Tryon | 114/322 |
| 4,010,619 A | * | 3/1977 | Hightower et al. | 405/191 |
| 4,502,407 A | | 3/1985 | Stevens | |
| 4,686,927 A | * | 8/1987 | Hawkes et al. | 114/312 |
| 4,706,119 A | | 11/1987 | Shatto, Jr. et al. | |
| 4,732,215 A | | 3/1988 | Hopper | |
| 5,235,931 A | * | 8/1993 | Nadolink | 114/321 |
| 5,995,882 A | * | 11/1999 | Patterson et al. | 701/21 |

FOREIGN PATENT DOCUMENTS

| | | | | |
|---|---|---|---|---|
| GB | 2 210 838 | | 6/1989 | |
| JP | 0173787 | * | 7/1988 | 114/51 |
| JP | 03 266794 A | | 11/1991 | |

OTHER PUBLICATIONS

"Autonomous Underwater Vehicles (AUVs)", http://www.ise.bc.ca/auv.html, (downloaded Aug. 31, 1999).
"Remotely Operated Vehicles (ROVs)", http://www.ise.bc.ca/rov.html, (downloaded Aug. 31, 1999).
"Hybrid Wet–Mate Connectors: 'Writing the Next Chapter'", Dr. James Cairns, Sea Technology.
"AUVs—this is what the oil industry wants", International Ocean Systems Design, vol. 3, No. 4, pp. 12–15 (Jul./Aug. 1999).
"French group developing production umbilical AUV", Offshore, pp. 66 and 158 (Oct. 1998).
Vol. 018 No. 083 (M–1216) Feb. 28, 1992 Japan.

* cited by examiner

*Primary Examiner*—S. Joseph Morano
*Assistant Examiner*—Andrew D. Wright
(74) *Attorney, Agent, or Firm*—Akerman Senterfitt

(57) ABSTRACT

An apparatus and methods for deploying, recovering, and servicing an AUV are disclosed. The apparatus includes a linelatch system that is made up of a tether management system connected to a flying latch vehicle by a tether. The linelatch system can be connected to a surface vessel by an umbilical on one end and to an AUV on the other end. In addition to providing a mechanical connection, between the AUV and a surface vessel, the linelatch system can also carry power and data between the surface vessel (i.e., through the umbilical) and the AUV.

12 Claims, 10 Drawing Sheets

APPARATUS AND METHOD FOR DEPLOYING, RECOVERING, SERVICING, AND OPERATING AN AUTONOMOUS UNDERWATER VEHICLE

CROSS-REFERENCE TO RELATED APPLICATIONS (Not Applicable)

STATEMENT REGARDING FEDERALLY SPONSORED RESEARCH OR DEVELOPMENT (Not Applicable)

FIELD OF THE INVENTION

The invention relates to the field of systems for deployment, recovery, servicing, and operation of underwater equipment and methods for utilizing such systems. More particularly, the invention relates to devices and methods for deploying, recovering, servicing, and operating an autonomous underwater vehicle.

BACKGROUND OF THE INVENTION

Vehicles that operate underwater are useful for performing tasks below the sea surface in such fields as deep water salvage, the underwater telecommunications industry, the offshore petroleum industry, offshore mining, and oceanographic research. (See, e.g., U.S. Pat. Nos. 3,099,316 and 4,502,407). One class of underwater vehicle is designated an autonomous underwater vehicle (AUV). AUVs are so named because they can operate without being physically connected to a support platform such as a land-based platform, an offshore platform, or a sea-going vessel.

Commonly used AUVs are essentially unmanned submarines that contain an on-board power supply, propulsion means, and a pre-programmed control system. In a typical operation, after being placed into a body of water from a surface platform, an AUV will carry out a pre-programmed mission, then automatically surface for recovery. A recovery boat is then dispatched to collect the surfaced AUV. The recovery procedure can be performed directly from the recovery boat or with the assistance of a diver. This procedure entails attaching a lift cable to the surfaced AUV so that it can be hauled out of the water using a crane or winch. Once recovered, the AUV is transferred to the surface platform or other servicing site where data obtained from the mission can be down-loaded, the AUV's batteries recharged, other components serviced, and new mission instructions programmed into the AUV's control device. The AUV is then redeployed into the body of water so that it can carry out another mission.

In this fashion, AUVs can perform subsurface tasks without requiring either constant attention from a technician or a physical link to a surface support platform. These attributes make AUV operations substantially less expensive than similar operations performed by underwater vehicles requiring a physical linkage to a surface support platform (e.g., remotely operated vehicles).

AUVs, however, suffer practical limitations rendering them less suited than other underwater vehicles for some operations. For example, because AUVs typically derive their power from an on-board power supply of limited capacity (e.g., a battery), tasks requiring a substantial amount of power such as cutting and drilling are not practically performed by AUVs. In addition, the amount of time that an AUV can operate underwater is limited by the capacity of the on-board power supply. Thus, AUVs must surface, be recovered, and be recharged between missions.

This recovery, servicing, and redeployment step reduces the productive operating time of an AUV. Moreover, it creates the additional expense associated with deployment of a recovery boat, diver, etc. In addition, the recovery and redeployment processes increase the likelihood that the AUV will be damaged. For example, AUVs can be damaged during surfacing by colliding with objects on the sea surface such as the surface support vessel. AUVs can also be damaged during the recovery process by colliding with the recovery cable, the side of a surface vessel or boat, or a portion of the crane or winch. In rough seas, recovery is hampered and made more dangerous by vertical heave, the up and down motion of an object produced by waves on the surface of a body of water. Severe vertical heave can render AUV recovery impractical.

Because AUVs are not physically linked to a surface vessel during underwater operations, communication between an AUV and a remotely-located operator (e.g., a technician aboard a surface vessel) is limited. For example, AUVs typically employ a conventional acoustic modem for communicating with a remotely-located operator. Such underwater acoustic communications do not convey data as rapidly or accurately as electrical wires or fiber optics. Transfer of data encoding real time video signals or real time instructions from a remotely-located operator is therefore inefficient. As such, AUVs are often not able to perform unanticipated tasks or jobs requiring a great deal of operator input without first being recovered, reprogrammed, and redeployed.

SUMMARY OF THE INVENTION

The present application is directed to a remotely operable underwater apparatus for deploying, recovering, servicing, and operating an AUV. In one aspect, the apparatus of the invention reduces the frequency of necessary AUV recoveries. In another aspect, the apparatus of the invention reduces the risk of damage to an AUV resulting from the recovery process.

The apparatus of the invention includes a linelatch system that is made up of a tether management system connected to a flying latch vehicle by a tether. The linelatch system can be connected to a surface platform by an umbilical on one end and to an AUV on the other end. In addition to providing a mechanical connection, between the AUV and a surface platform , the linelatch system can also carry power and data between the surface platform (i.e., through the umbilical) and the AUV.

The flying latch vehicle is a highly maneuverable, remotely-operable underwater vehicle that has a connector adapted to "latch" on to or physically engage a receptor on an AUV. In addition to stabilizing the interaction of the flying latch vehicle and the AUV, the connector-receptor engagement can also be utilized to transfer power and data. In this aspect, the flying latch vehicle is therefore essentially a flying power outlet for recharging the on-board power supply of an AUV, and a flying data modem for transferring information to and from an AUV (e.g., uploading mission results, downloading revised mission instructions, etc).

The tether management system of the linelatch system regulates the quantity of free tether between itself and the flying latch vehicle. It thereby permits the linelatch system to switch between two different configurations: a "closed configuration" in which the tether management system physically abuts the flying latch vehicle; and an "open configuration" in which the tether management system and flying latch vehicle are separated by a length of tether. In the open configuration, slack in the tether allows the flying latch vehicle to move independently of the tether management system. Transmission of heave-induced movement between the two components is thereby removed or reduced.

Accordingly, in one aspect, the invention features a method of servicing an automated submersible vehicle (i.e., an AUV) in a body of water by communicating power, data, and/or materials (e.g., fluids and gases) between a vessel and the automated submersible vehicle. This method includes the steps of: deploying a connector (i.e., a linelatch system) connected to the vessel into the body of water; remotely maneuvering the connector to the automated submersible vehicle; connecting the connector to the automated submersible vehicle; communicating power, data, and/or materials between the vessel and the automated submersible vehicle; and detaching the connector from the automated submersible vehicle. In this method, more than about 50% of the power transmitted to the connector can be transmitted to automated submersible vehicle during the communicating step. This method can also further include the step of retrieving the connector.

Unless otherwise defined, all technical terms used herein have the same meaning as commonly understood by one of ordinary skill in the art to which this invention belongs. Although methods and materials similar or equivalent to those described herein can be used in the practice or testing of the present invention, suitable methods and materials are described below. All publications, patent applications, patents, and other references mentioned herein are incorporated by reference in their entirety. In the case of conflict, the present specification, including definitions will control. In addition, the particular embodiments discussed below are illustrative only and not intended to be limiting.

BRIEF DESCRIPTION OF THE DRAWINGS

The invention is pointed out with particularity in the appended claims. The above and further advantages of this invention may be better understood by referring to the following description taken in conjunction with the accompanying drawings which:

DETAILED DESCRIPTION

The invention encompasses underwater devices including a linelatch system adapted to be operated from a remote location above the surface of a body of water and utilized for deploying, recovering, servicing, and/or operating AUVs. The below described preferred embodiments illustrate various adaptations of the invention. Nonetheless, from the description of these embodiments, other aspects of the invention can be readily fashioned by making slight adjustments or modifications to the components discussed below.

Figure 1A:
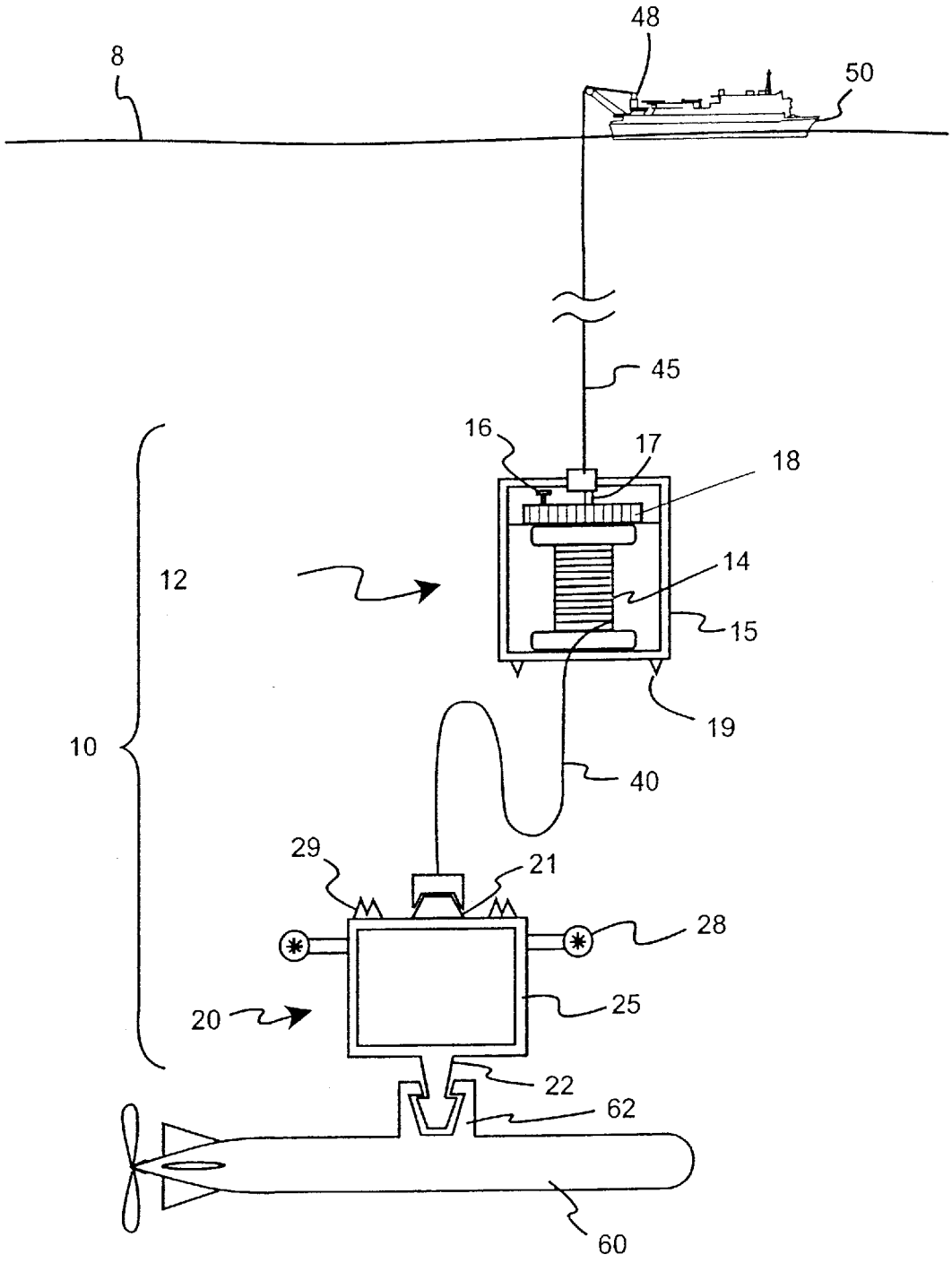
FIG. 1A is a schematic view of a linelatch system of the invention shown in the open configuration.
Figure 1B:
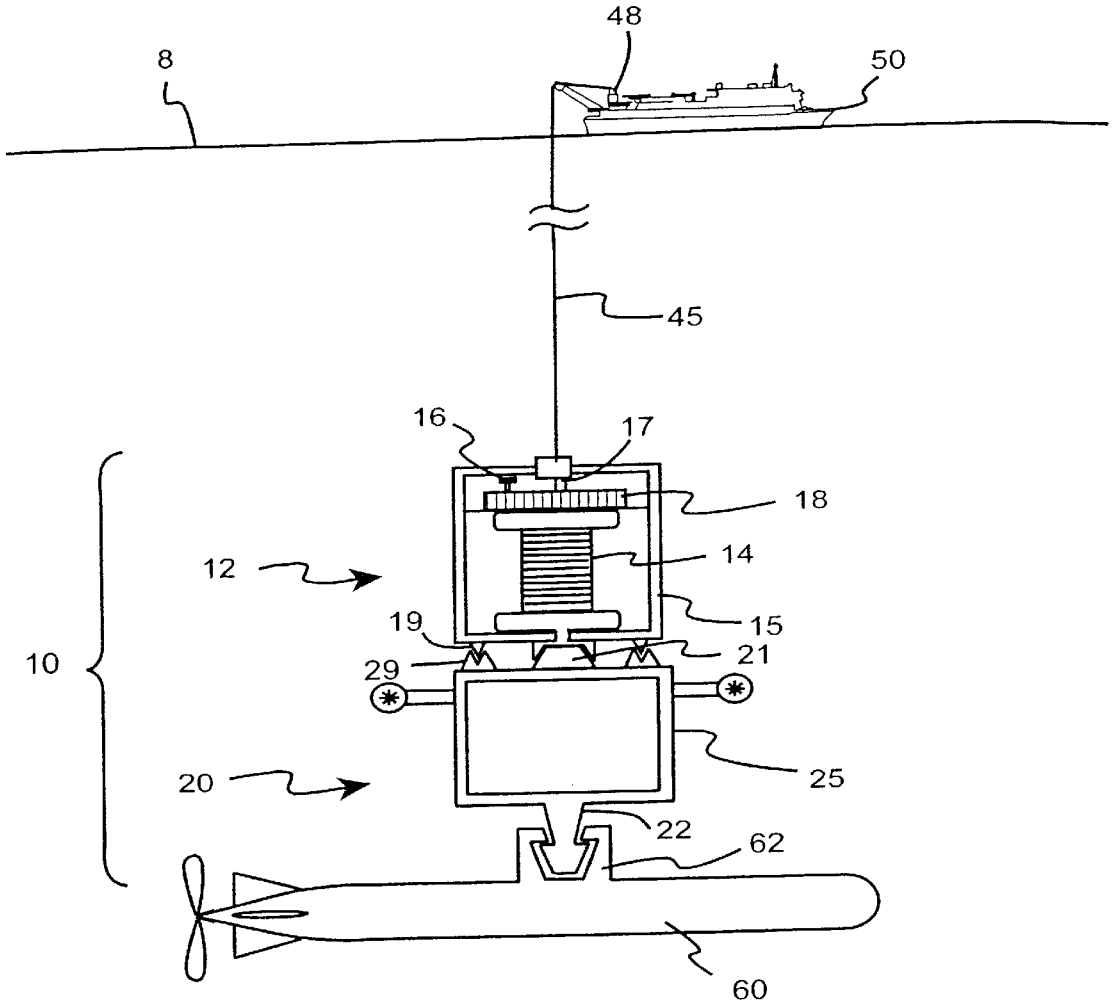
FIG. 1B is a schematic view of a linelatch system of the invention shown in the closed configuration.

Referring now to FIGS. 1A and 1B of the drawings, the presently preferred embodiment of the invention features a linelatch system 10 including a tether management system 12 connected to a flying latch vehicle 20 by a tether 40. In FIGS. 1A and 1B, linelatch system 10 is shown positioned below the surface of a body of water 8 connected to a surface support vessel 50 floating on the surface of the body of water 8 by an umbilical 45.

Tether management system 12 can be any device that can reel in or pay out tether 40. Tether management systems suitable for use as tether management system 12 are well known in the art and can be purchased from several sources (e.g., from Slingsby Engineering, United Kingdom; All Oceans, United Kingdom; and Perry Tritech, Inc., Jupiter, Fla.). In preferred embodiments, however, tether management system 12 includes an external frame 15 which houses a spool 14, a spool control switch 16, and a spool motor 18.

Frame 15 forms the body of tether management system 12. It can be any device that can house and/or attach system 12 components such as spool 14, spool control switch 16, and spool motor 18. For example, frame 15 can take the form of a rigid shell or skeleton-like framework. In the presently preferred embodiment, frame 15 is a metal cage. A metal cage is preferred because it moves easily through water, and also provides areas for mounting other components of tether management system 12.

Spool 14 is a component of tether management system 12 that controls the length of tether 40 dispensed from system 12. It can be any device that can reel in, store, and pay out tether 40. For example, spool 14 can take the form of a winch about which tether 40 can be wound and unwound. In preferred embodiments, spool 14 is a rotatable cable drum, where rotation of the drum in one direction causes tether 40 to be payed out of tether management system 12 by unreeling it from around the drum, and rotation of the drum in the other direction causes tether 40 to be taken up by tether management system 12 by reeling it up around the drum. In addition to the foregoing, other devices for guiding, introducing, or removing tension in tether 40 are known in the art and can be used in the invention.

Spool motor 18 provides power to operate spool 14. Spool motor 18 can be any device that is suitable for providing power to spool 14 such that spool 14 can reel in or pay out tether 40 from tether management system 12. For example, spool motor 18 can be a motor that causes spool 14 to rotate clockwise or counterclockwise to reel in or pay out tether 40. In preferred embodiments, spool motor 18 is an electrically or hydraulically-driven motor.

Spool control switch 16 is a device that controls the action of spool motor 18. It can be any type of switch or other device which allows an operator of linelatch system 10 to control spool motor 18. In a preferred form, it is a remotely-operable electrical switch or a hydraulic control valve that can be controlled by a technician or pilot on surface support vessel 50 so that motor 18 can power spool 14 operation.

Tether management system 12 can also include a power transfer unit for transferring power and data 17 between umbilical 45 and tether 40. Power transfer unit 17 can be any apparatus that can convey power and data between umbilical 45 and tether 40. In preferred embodiments of the invention, means 17 takes the form of electrical, hydraulic and/or fiber optic lines connected at one end to umbilical 45 and at the other end to tether 40.

Attached to tether management system 12 is umbilical 45, a long cable-like device used to move linelatch system 10 between a surface platform such as surface support vessel 50 and various subsurface locations via launching and recovery device 48 (e.g., a crane, an "A frame," or a winch). Umbilical 45 can be any device that can physically connect linelatch system 10 and a surface platform. Preferably, it is long enough so that linelatch system 10 can be moved between the surface of a body of water and a subsurface location such as the sea bed. In preferred embodiments, umbilical 45 is negatively buoyant (although neutrally or positively buoyant umbilcals can also be used), fairly rigid, and includes an umbilical port capable of transferring power and/or data between tether management system 12 and umbilical 45 (i.e. for conveyance to surface support vessel 50). In some embodiments, the umbilical port of umbilical 45 includes two or more ports. For example, the umbilical port can have a first port for communicating power between tether management system 12 and umbilical 45, and second port for communicating data between tether management system 12 and umbilical 45 More preferably, umbilical 45 is a waterproof steel armored cable that houses a conduit for both power (e.g., an electricity-conducting wire and/or a hydraulic hose) and data communication (e.g., fiber optic cables for receipt and transmission of data). Umbilicals suitable for use in the invention are commercially available from several sources (e.g., NSW, Rochester, and Alcatel).

Also attached to tether management system 12 is tether 40. It has two ends or termini, one end being securely attached to tether management system 12, the other end being securely attached to tether fastener 21 of flying latch vehicle 20. While tether 40 can be any device that can physically connect tether management system 12 and flying latch vehicle 20, it preferably takes the form of a flexible, neutrally buoyant rope-like cable that permits objects attached to it to move relatively freely. In particularly preferred embodiments, tether 40 also includes a power and data communications conduit (e.g., electricity-conducting wire, hydraulic hose, fiber optic cable, etc.) so that power and data can be transferred through it.

Tethers suitable for use in the invention are known in the art and are commercially available (e.g., Perry Tritech, Inc.; Southbay; Alcatel; NSW; and JAQUES).

Attached to the terminus of tether 40 opposite tether management system 12 is flying latch vehicle 20. Flying latch vehicle 20 is a remotely-operated underwater craft designed to mate with an undersea device for the purpose of transferring power to and/or exchanging data with the undersea device. Vehicle 20 may also include a mechanical/structural attachment for deployment and recovery of undersea devices. In preferred embodiments, flying latch vehicle 20 includes tether fastener 21, chassis 25, connector 22, and propulsion system 28.

Chassis 25 is a rigid structure that forms the body and/or frame of vehicle 20. Chassis 25 can be any device to which various components of vehicle 20 can be attached. For example, chassis 25 can take the form of a metal skeleton. In preferred embodiments, chassis 25 is a hollow metal or plastic shell to which the various components of vehicle 20 are attached. In the latter form, the interior of chassis 25 can be sealed from the external environment so that components included therein can be isolated from exposure to water and pressure. In the preferred embodiment shown in FIGS. 1A and 1B, components shown affixed to or integrated with chassis 25 include tether fastener 21, connector 22, propulsion system 28, and male alignment guides 19.

Tether fastener 21 connects tether 40 to flying latch vehicle 20. Tether fastener 21 can be any suitable device for attaching tether 40 to flying latch vehicle 20. For example, it can take the form of a mechanical connector adapted to be fastened to a mechanical receptor on the terminus of tether 40. In preferred embodiments, tether fastener 21 is the male or female end of bullet-type mechanical fastener (the terminus of tether 40 having the corresponding type of fastener). In other embodiments, tether fastener 21 can also be part of a magnetic or electromagnetic connection system. For embodiments within the invention that require a power and/or data conduit between tether 40 and flying latch vehicle 20, tether fastener 21 preferably includes a tether port for conveying power and/or data between tether 40 and flying latch vehicle 20 (e.g., by means of integrated fiber optic, electrical or hydraulic connectors).

Mounted on or integrated with chassis 25 is connector 22, a structure adapted for detachably connecting receptor 62 of AUV 60 so that flying latch vehicle 20 can be securely but reversibly attached to AUV 60. Correspondingly, receptor 62 is a structure on AUV 60 that is detachably connectable to connector 22. Although, in preferred embodiments, connector 22 and receptor 62 usually form a mechanical coupling, they may also connect one another through any other suitable means known in the art (e.g., magnetic or electromagnetic). As most clearly illustrated in FIG. 2, in a particularly preferred embodiment connector 22 is a bullet-shaped male-type connector. This type of connector is designed to mechanically mate with a funnel-shaped receptacle such as receptor 62 shown in FIG. 2. The large diameter opening of the funnel-shaped receptor 62 depicted in FIG. 2 facilitates alignment of a bullet-shaped connector 22 during the mating process. That is, in this embodiment, if connector 22 was slightly out of alignment with receptor 62 as flying latch vehicle 20 approached AUV 60 for mating, the funnel of receptor 62 would automatically align the bullet-shaped portion of connector 22 so that vehicle 20's motion towards receptor 62 would automatically center connector 22 for proper engagement.

Connector 22 and receptor 62 can also take other forms so long as they are detachably connectable to each other. For example, connector 22 can take the form of a plurality of prongs arranged in an irregular pattern when receptor 62 takes the form of a plurality of sockets arranged in the same irregular pattern so that connector 22 can connect with receptor 62 in one orientation only. As another example, connector 22 can be a funnel-shaped female type receptacle where receptor 62 is a bullet-shaped male type connector. In addition to providing a mechanical coupling, in preferred embodiments, the interaction of connector 22 and receptor 62 is utilized to transfer power and data between flying latch vehicle 20 and AUV 60. (See below).

Also attached to chassis 25 is propulsion system 28. Propulsion system 28 can be any force-producing apparatus that causes undersea movement of flying latch vehicle 20 (i.e., "flying" of vehicle 20). Preferred devices for use as propulsion system 28 are electrically or hydraulically-powered thrusters. Such devices are widely available from commercial suppliers (e.g., Hydrovision Ltd., Aberdeen, Scotland; Innerspace, Calif. and others).

Figure 2:
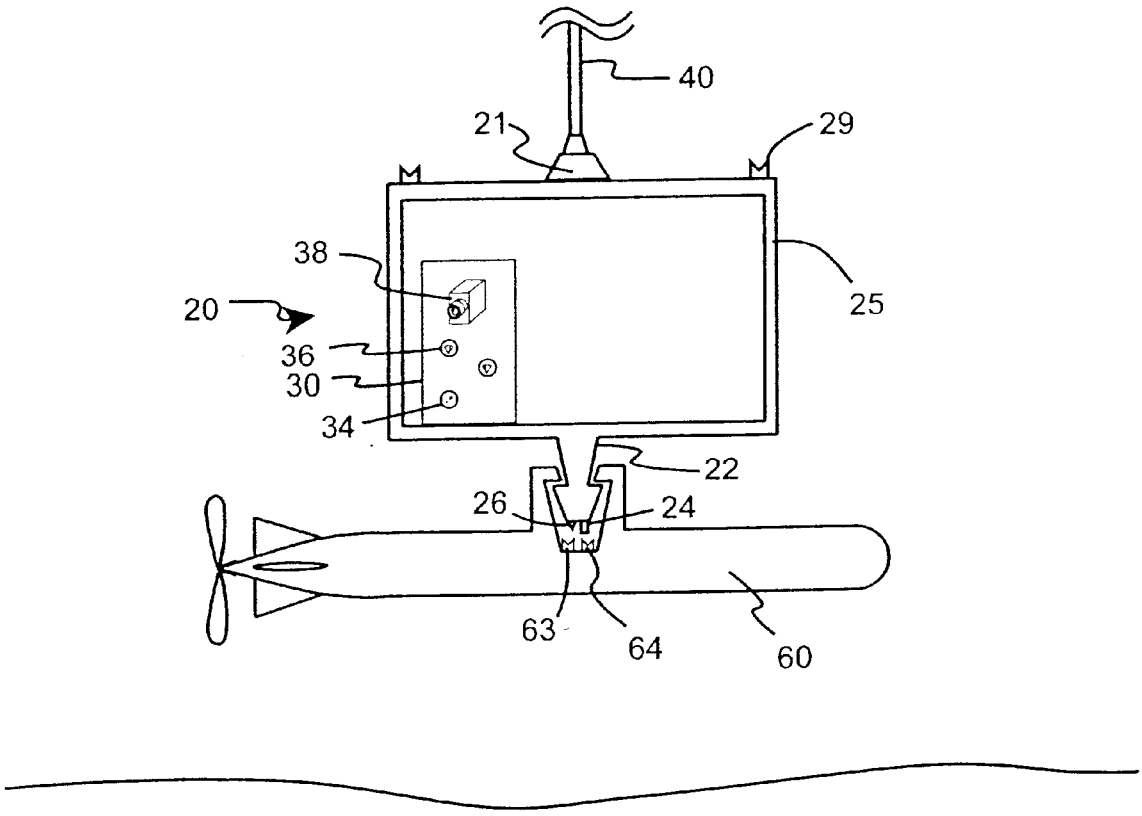
FIG. 2 is a schematic view of a flying latch vehicle of the invention shown interfacing with an autonomous underwater vehicle.

Referring now to FIG. 2, in preferred embodiments, flying latch vehicle 20 further includes a connector that may include an output port 24 and/or a communications port 26; and position control system 30 which may include compass 32, depth indicator 34, velocity indicator 36, and/or video camera 38.

Power output port 24 can be any device that mediates the underwater transfer of power from flying latch vehicle 20 to another underwater apparatus such as AUV 60. In preferred embodiments, port 24 physically engages power inlet 64 on AUV 60 such that power exits flying latch vehicle 20 from port 24 and enters AUV 60 through power inlet 64. Preferably, the power conveyed from power output port 24 to power inlet 64 is electrical current or hydraulic power (derived, e.g., from surface support vehicle 50) to AUV 60). In particularly preferred embodiments, power output port 24 and power inlet 64 form a "wet-mate"-type connector (i.e., an electrical, hydraulic, and/or optical connector designed for mating and demating underwater). In the embodiment shown in FIG. 2, port 24 is integrated into connector 22 and power inlet 64 is integrated with receptor 62. In other embodiments, however, port 24 is not integrated with connector 22 but attached at another location on flying latch vehicle 20, and inlet 64 is located on AUV 60 such that it can engage port 24 when vehicle 20 and AUV 60 connect. For example, port 24 could take the form of a funnel-shaped receptacle device that engages the inlet 64 which in this is integrated into a conically-shaped nose of AUV 60 configured to engage port 24.

The components of flying latch vehicle 20 can function together as a power transmitter for conveying power from tether 40 (e.g., supplied from surface support vessel 50, through umbilical 45 and tether management system 12) to an underwater apparatus such as AUV 60. For example, power can enter vehicle 20 from tether 40 through tether fastener 21. This power can then be conveyed from fastener 21 through a power conducting apparatus such as an electricity-conducting wire or a hydraulic hose attached to or housed within chassis 25 into power output port 24. Power output port 24 can then transfer the power to the underwater apparatus as described above. In preferred embodiments of the flying latch vehicle of the invention, the power transmitter has the capacity to transfer more than about 50% (e.g., approximately 50%, 55%, 60%, 65%, 70%, 75%, 80%, 85%, 90%, 95%, 100%) of the power provided to it from an external power source such as surface support vessel 50 (i.e., via umbilical 45 and tether 40) to AUV 60. Power not conveyed to AUV 60 from the external power source can be used to operate various components on flying latch vehicle 20 (e.g., propulsion system 28 and position control system 30). As one example, of 100 bhp of power transferred to vehicle 20 from vessel 50, 20 bhp is used by flying latch vehicle 20, and 80 bhp used by AUV 60.

Communications port 26 is a device that physically engages communications acceptor 63 on AUV 60. Port 26 and acceptor 63 mediate the transfer of data between flying latch vehicle 20 and AUV 60. For example, in the preferred configuration shown in FIG. 2, communications port 26 is a fiber optic cable connector integrated into connector 22, and acceptor 63 is another fiber optic connector integrated with receptor 62 in on AUV 60. The port 26-acceptor 63 connection can also be an electrical connection (e.g., telephone wire) or other type of connection (e.g., magnetic or acoustic). In particularly preferred embodiments, the communications port 26-communications acceptor 63 connection and the power output port 24-power inlet 64 connection are integrated into one "wet-mate"-type connector. In other embodiments, communications port 26 is not integrated with connector 22 but attached at another location on flying latch vehicle 20, and acceptor 63 is located on AUV 60 such that it can engage port 26 when vehicle 20 and AUV 60 connect. Communications port 26 is preferably a two-way communications port that can mediate the transfer of data both from flying latch vehicle 20 to AUV 60 and from AUV 60 to vehicle 20.

Communications port 26 and acceptor 63 can be used to transfer information (e.g., video output, depth, current speed, location information, etc.) from AUV 60 to a remotely-located operator (e.g, on surface vessel 50) via linelatch 10 and umbilical 45. Similarly, port 26 and acceptor 63 can be used to transfer information (e.g., mission instructions, data for controlling the location and movement of AUV 60, data for controlling mechanical arms and like manipulators on AUV 60, etc.) between a remote location (e.g., on surface support vessel 50) and AUV 60.

Position control system 30 is any system or compilation of components that controls underwater movement of flying latch vehicle 20, and/or provides telemetry data from vehicle 20 to a remotely-located operator. Such telemetry data can be any data that indicates the location and/or movement of flying latch vehicle 20 (e.g., depth, longitude, latitude, depth, speed, direction), and any related data such as sonar information, pattern recognition information, video output, temperature, current direction and speed, etc. Thus, position control system 30 can include such components as sonar systems, bathymetry devices, thermometers, current sensors, compass 32, depth indicator 34, velocity indicator 36, video camera 38, etc. These components may be any of those used in conventional underwater vehicles or may be specifically designed for use with linelatch system 10. Suitable such components are available from several commercial sources.

The components of position control system 30 for controlling movement of flying latch vehicle 20 are preferably those that control propulsion system 28 so that vehicle 20 can be directed to move eastward, westward, northward, southward, up, down, etc. These can, for example, take the form of remotely-operated servos for controlling the direction of thrust produced by propulsion system 28. Other components for controlling movement of flying latch vehicle 20 may include buoyancy compensators for controlling the underwater depth of flying latch vehicle 20 and heave compensators (e.g., interposed between tether management system 12 and umbilical 45) for reducing wave-induced motion of flying latch vehicle 20. A remotely-positioned operator can preferably receive output signals (e.g., telemetry data) and send instruction signals (e.g., data to control propulsion system 28) to position control system 30 through the data communication conduit included within umbilical 45 via the data communications conduits within tether management system 12 and tether 40.

One or more of the components comprising position control system 30 can be used as a guidance system for docking flying latch vehicle 20 to AUV 60. For example, the guidance system could provide a remotely-controlled pilot of vehicle 20 with the aforementioned telemetry data and a video image of receptor 62 on AUV 60 such that the pilot could precisely control the movement of vehicle 20 into the docked position with AUV 60 using the components of system 30 that control movement of vehicle 20. As another example, for computer-controlled docking, the guidance system could use data such as pattern recognition data to align vehicle 20 with AUV 60 and the components of system 30 that control movement of vehicle 20 to automatically maneuver vehicle 20 into the docked position with AUV 60.

As shown in FIGS. 1A and 1B, linelatch system 10 can be configured in an open position or in a closed configuration. In FIG. 1A, linelatch system 10 is shown in the open position where tether management system 12 is separated from flying latch vehicle 20 and tether 40 is slack. In this position, to the extent of slack in tether 40, tether management system 12 and flying latch vehicle 20 are independently moveable from each other. in comparison, in FIG. 1B, linelatch system 10 is shown in the closed position. In this configuration, tether management system 12 physically abuts flying latch vehicle 20 and tether 40 is withdrawn into tether management system 12. In order to prevent lateral movement of tether management system 12 and flying latch vehicle 20 when linelatch system 10 is in the closed configuration, male alignment guides 19 can be affixed to tether management system 12 so that they interlock the female alignment guides 29 affixed to flying latch vehicle 20. Male alignment guides 19 can be any type of connector that securely engages female alignment guides 29 such that movement of system 12 is restricted with respect to vehicle 20, and vice versa. Via the connection of guides 19 and 29, system 12 and vehicle 20 can structurally cooperate to support a load (e.g., the weight of a load attached by vehicle 20).

Several other components known in the art of underwater vehicles can be included on linelatch system 10. One skilled in this art, could select these components based on the particular intended application of linelatch system 10. For example, for applications where umbilical 45 becomes detached from linelatch system 10, an on-board auxiliary power supply (e.g., batteries, fuel cells, and the like) can be included on linelatch system 10. Likewise, an acoustic modem could be included within linelatch system 10 to provide an additional communications link among, for example, linelatch system 10, attached AUV 60, and surface support vessel 50. In yet another example where AUV 60 is powered by a liquid fuel, the fuel can be transferred to AUV 60 from surface vessel 50 via umbilical 45 and a suitable connector configured on linelatch system 10.

Methods of using linelatch system 10 are also within the invention. For example, as illustrated in FIGS. 3A–E, linelatch system 10 can be utilized for deploying and/or recovering an underwater device 60 to or from a subsurface location (i.e., anywhere between the surface of body of water 8 and the seabed). Although reference will be made hereinafter to deploying and/or recovering an AUV 60, the invention can be used to deploy and/or recover any underwater device to or from a subsurface location.

In this method, linelatch system 10 serves as a mechanical link between surface support vessel 50 and AUV 60. In preferred embodiments, this method includes the steps of deploying linelatch system 10 from surface vessel 50 into body of water 8; placing linelatch system 10 in the open position; maneuvering flying latch vehicle 20 to AUV 60; aligning and mating vehicle 20 with AUV 60; returning linelatch system 10 to the closed position; and hauling system 10 with attached AUV 60 to the surface of body of water 8 for recovery.

Figure 3A:
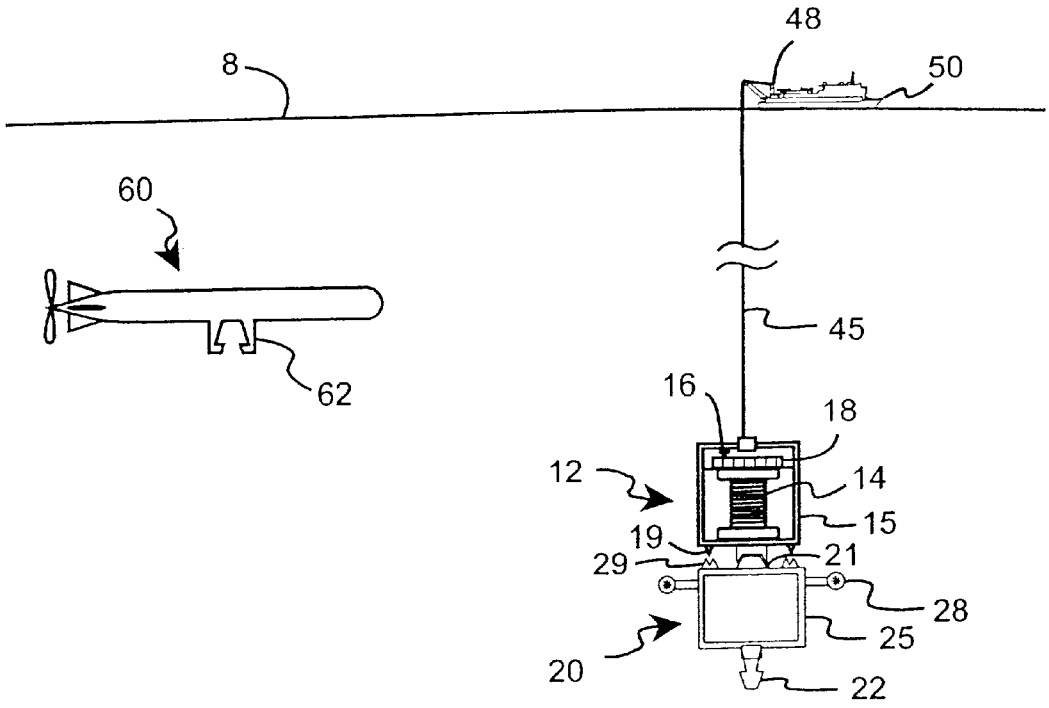
FIGS. 3A–E are schematic views showing the use of a linelatch system for recovering with autonomous underwater vehicle from a subsurface location.

FIG. 3A shows linelatch system 10 at a subsurface location in the closed configuration after having been deployed from surface support vessel 50. System 10 can be deployed from vessel 50 by any method known in the art. For example, linelatch system 10 can be lowered into body of water 8 using a winch. Preferably, to prevent damage, linelatch system 10 is gently lowered from vessel 50 using launching and recovery device 48 (e.g., a crane) and umbilical 45.

Figure 3B:
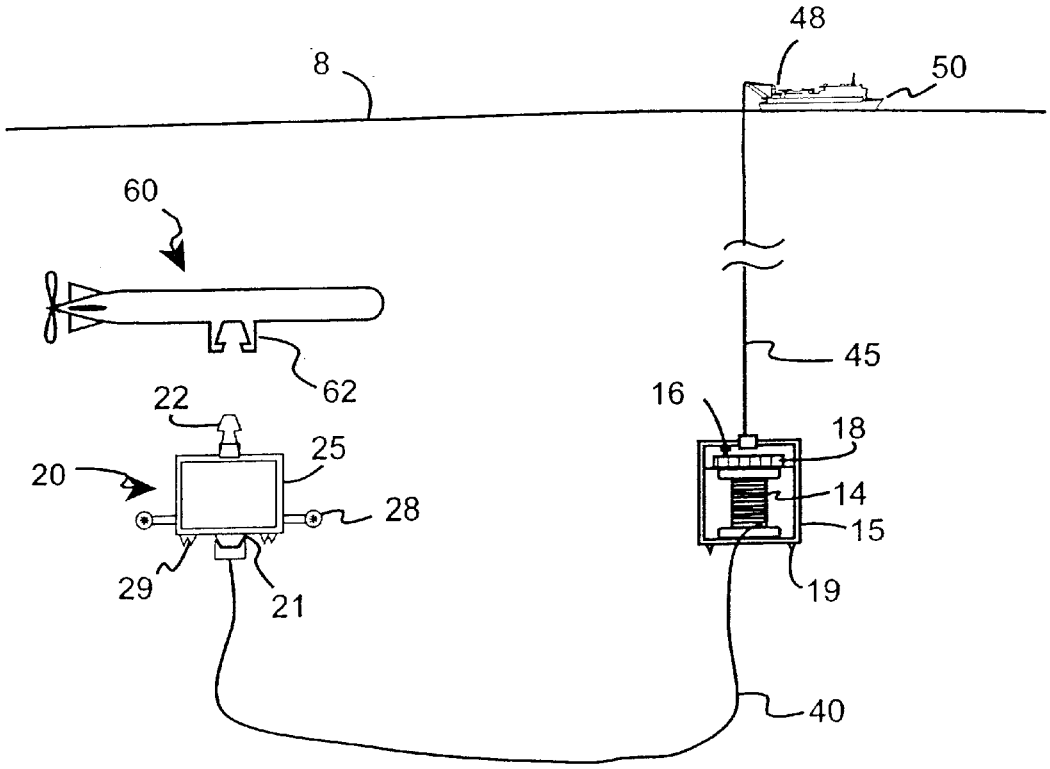

In FIG. 3B, linelatch system 10 is shown in the open configuration where tether 40 has been played out of tether management system 12 and flying latch vehicle 20 flown away from system 12 towards AUV 60. As described above, after being deployed from vessel 50, linelatch system 10 can be placed in the open configuration by playing tether 40 out from tether management system 12. Propulsion system 28 on flying latch vehicle 20 can be used to move vehicle 20 away from system 12 to facilitate this process. In this position, slack in tether 40 uncouples any heave-induced movement of tether management system 12 from vehicle 20, facilitating the alignment of vehicle 20 with AUV 60.

After being separated from tether management system 12, flying latch vehicle 20 moves toward AUV 60 using propulsion system 28 and position control system 30 until it is aligned for mating with AUV 60. This alignment may be assisted using position control system 30. For example, video images of the receptor 62 on AUV 60 can be transmitted to a remotely-located operator using video camera 38. Using these images, the operator can use position control system 30 and propulsion system 28 to precisely mate connector 22 of flying latch vehicle 20 with receptor 62 of vehicle 60.

Figure 3C:
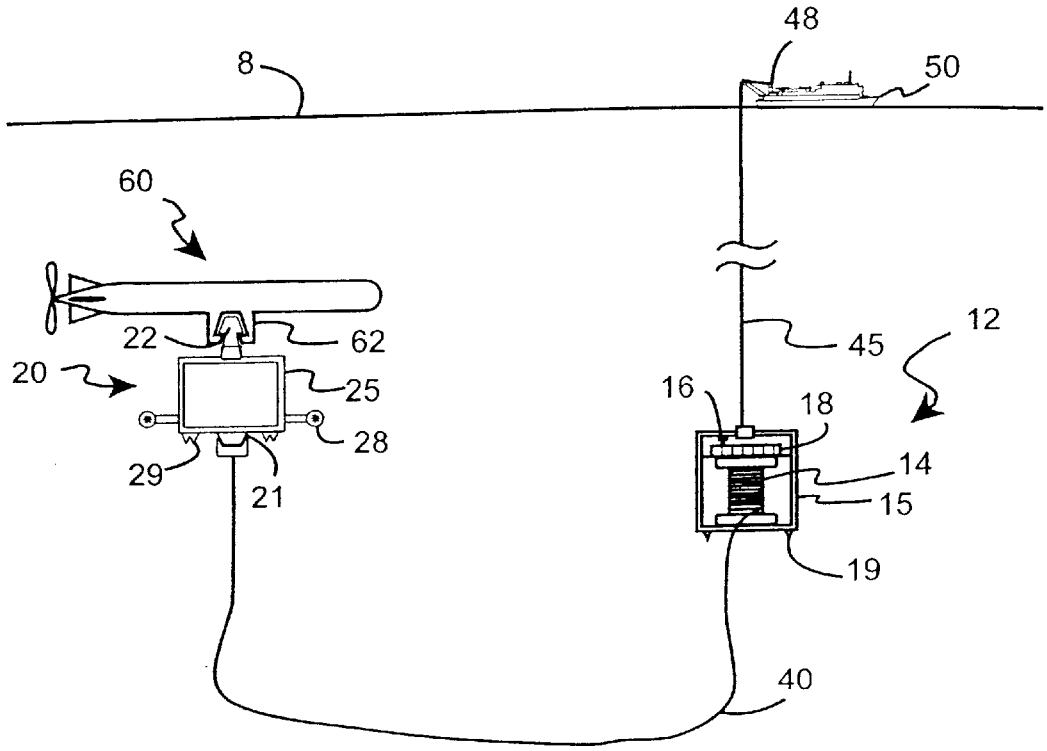

In FIG. 3C, flying latch vehicle 20 is shown physically engaging (i.e., docking) AUV 60. After proper alignment of flying latch vehicle 20 with AUV 60, vehicle 20 is moved (e.g., using propulsion system 28) a short distance toward AUV 60 so that connector 22 securely engages (i.e., docks) receptor 62.

Figure 3D:
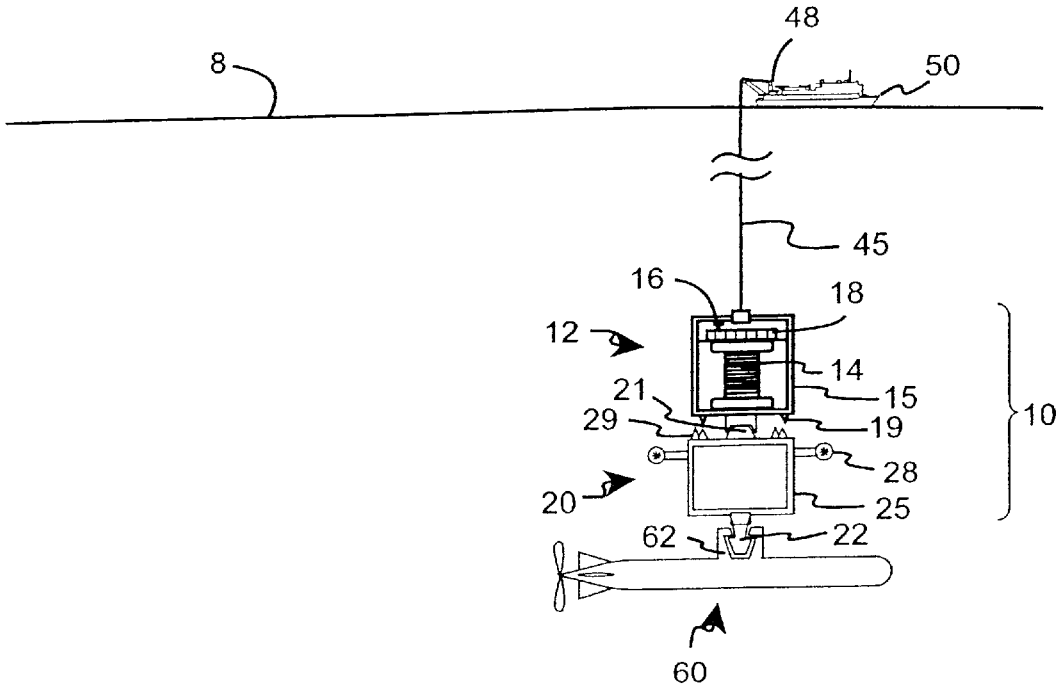

As illustrated in FIG. 3D, once flying latch vehicle 20 is docked to AUV 60, linelatch system 10 can be reconfigured into the closed position. In this step, tether 40 is reeled in by tether management system 12 so that flying latch vehicle 20 is moved adjacent to system 12 (with or without the assistance of propulsion system 28) such that linelatch system 10 is returned to the closed and locked configuration.

Figure 3E:
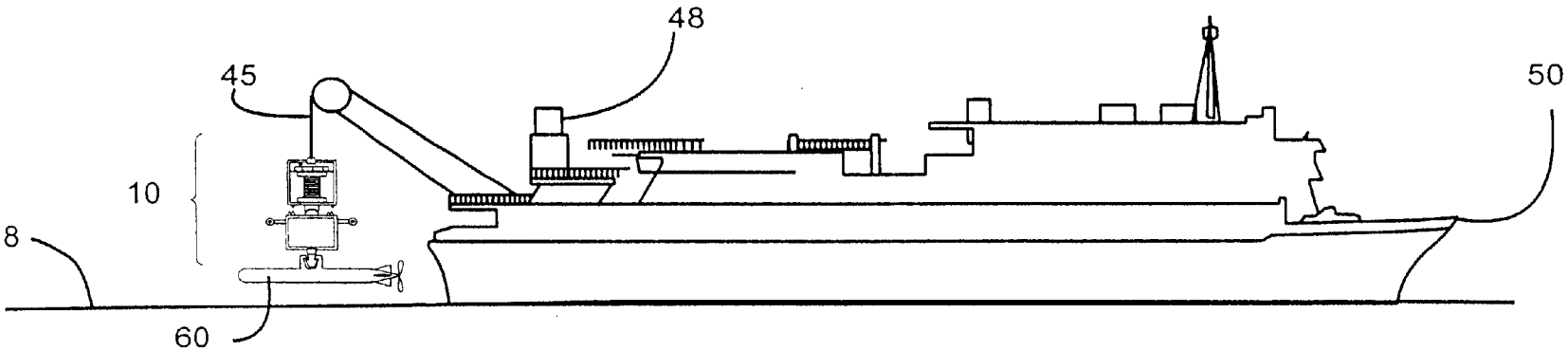

As shown in FIG. 3E, line latch system 10 with attached AUV 60 can be hauled to the surface of body of water 8 and recovered onto vessel 50. This step may be performed by any method known in the art. For example, system 10 with attached AUV 60 can be brought to the surface of body of water 8 using a winch on surface vessel 50. A recovery boat and diver can then be dispatched to manually remove AUV 60 from body of water 8 and return it to vessel 50. Preferably, to automate this recovery process, this step is performed by simply lifting system 10 with attached AUV 60 out of the body of water 8 onto the deck of vessel 50 using launching and recovery device 48 and umbilical 45.

By reversing the foregoing steps, AUV 60 can also be deployed from surface support vessel 50 to a subsurface location. Myriad variations on the foregoing methods can be made for deploying or recovering subsurface devices. For example, rather than using a surface vessel (e.g., surface support vessel 50), these methods can be performed from a surface platform such as a fixed or floating offshore platform, or even an underwater vehicle such as a submarine.

As another example, as illustrated in FIGS. 4A–E, linelatch system 10 can be utilized for recovering AUV 60 from the surface of a body of water. In this method, linelatch system 10 serves as a mechanical link between surface support vessel 50 and AUV 60. In preferred embodiments, this method includes the steps of deploying linelatch system 10 from surface vessel 50 into body of water 8; placing linelatch system 10 in the open position; maneuvering flying latch vehicle 20 to AUV 60; connecting a connector portion of vehicle 20 to a buoy line extending from AUV 60; returning linelatch system 10 to the closed position; and hauling system 10 with attached AUV 60 to surface vessel 50 for recovery.

Figure 4A:
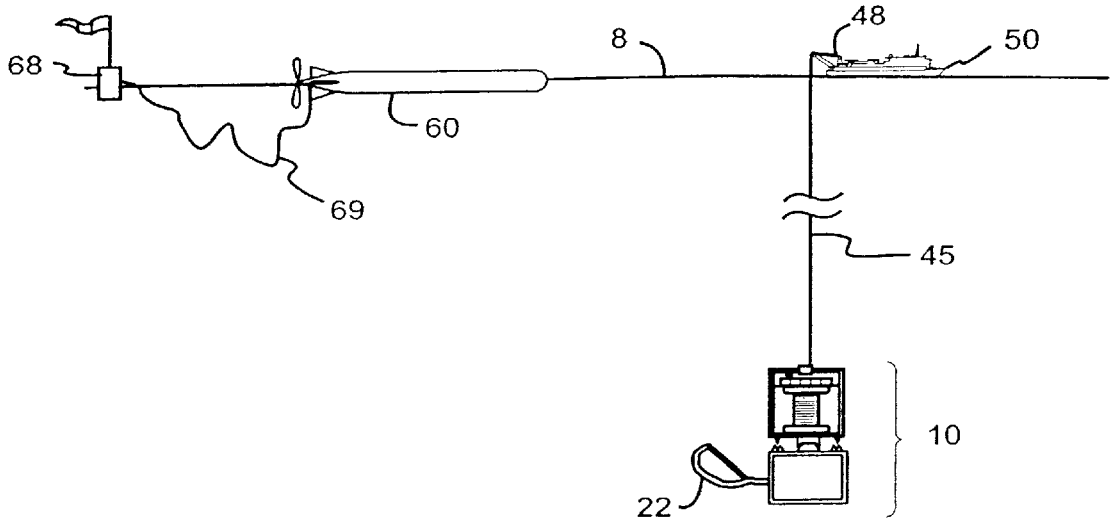
FIGS. 4A–E are schematic views showing the use of a linelatch system for recovering an autonomous underwater vehicle from a surface location.

In FIG. 4A, AUV 60 is shown floating on the surface of body of water 8 after having deployed a buoy 68 to assist in locating and recovering AUV 60. Buoy 68 is attached to AUV 60 by buoy line 69. Also in FIG. 4A, linelatch system 10 is shown at a subsurface location in the closed configuration after being lowered from surface support vessel 50 via launching and recovery device 48 and umbilical 45. System 10 can be deployed from vessel 50 by any method known in the art. For example, linelatch system 10 can be simply thrown over the side of vessel 50 into body of water 8, or lowered into body of water 8 using a winch. Preferably, to prevent damage, linelatch system 10 is gently lowered from vessel 50 using launching and recovery device 48 (e.g., a crane, an "A frame," or a winch) and umbilical 45. Although, launching and recovery device 48 is shown in the figures as a crane, it can alternatively take the form of a "moon pool" launching system, which is a vertical shaft through the hull of vessel 50, through which objects can be moved from the deck on a ship to a position in a body of water (not shown).

Figure 4B:
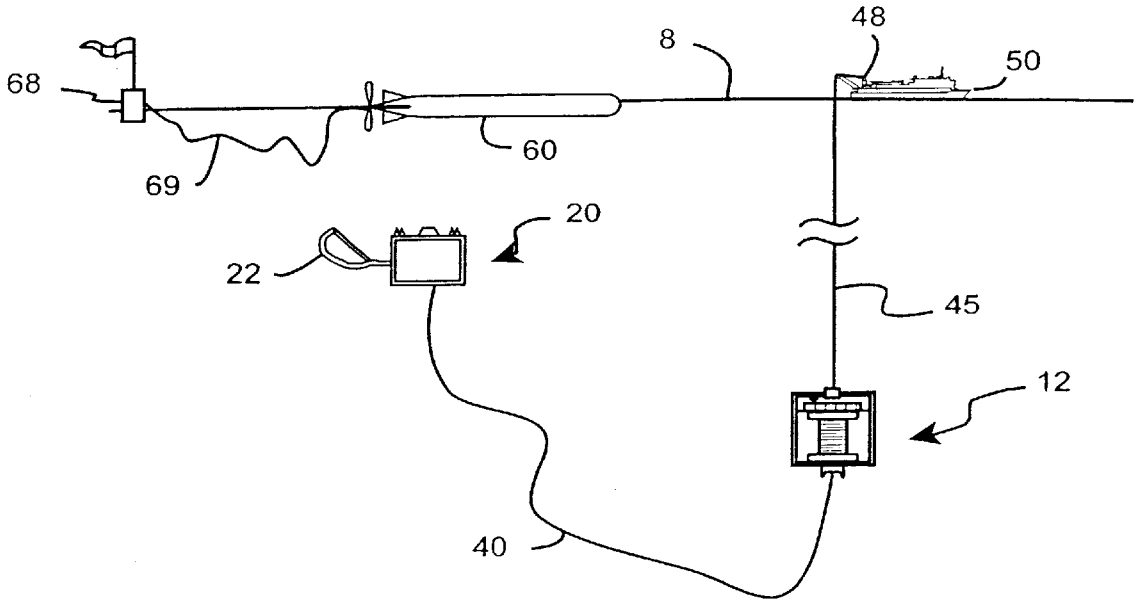

In FIG. 4B, linelatch system 10 is shown in the open configuration where tether 40 has been played out of tether management system 12 and flying latch vehicle 20 flown away from system 12 towards AUV 60. As described above, after being deployed from vessel 50, linelatch system 10 can be placed in the open configuration by playing tether 40 out from tether management system 12. Propulsion system 28 on flying latch vehicle 20 can be used to move vehicle 20 away from system 12 to facilitate this process.

Figure 4C:
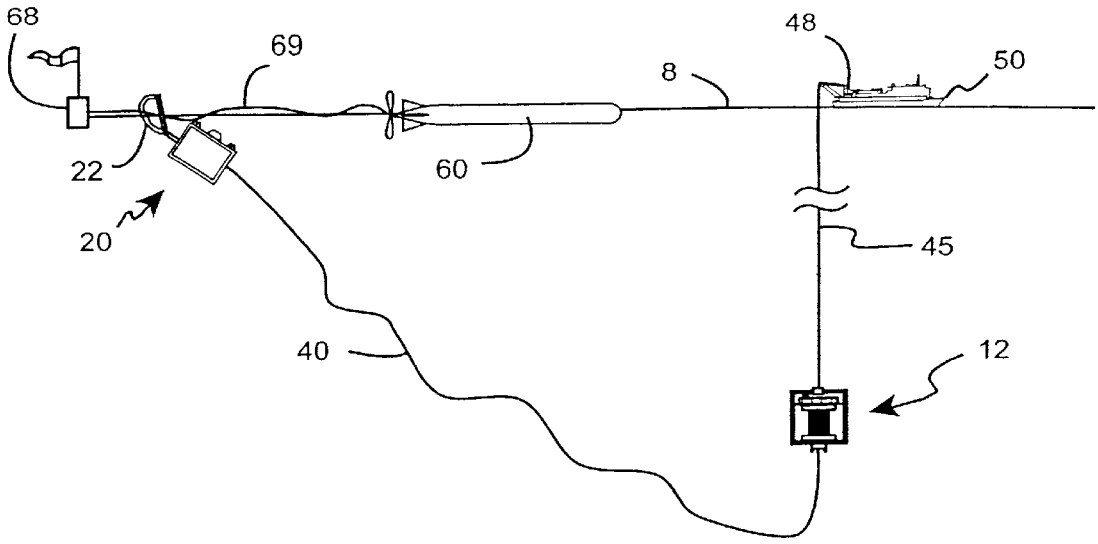

In FIG. 4C, flying latch vehicle 20 is shown physically engaging buoy line 69 using connector 22 (adapted in this example for securely engaging buoy line 69). Other means aside from connector 22 could be used to grasp line 69. The positioning of flying latch vehicle 20 for engagement of buoy line 69 is assisted using position control system 30 (not shown). For example, video images of the receptor 62 on AUV 60 can be transmitted to a remotely-located operator using video camera 38. Using these images, the operator can use position control system 30 and propulsion means 28 to maneuver connector 22 into a position suitable for engaging buoy line 69.

Figure 4D:
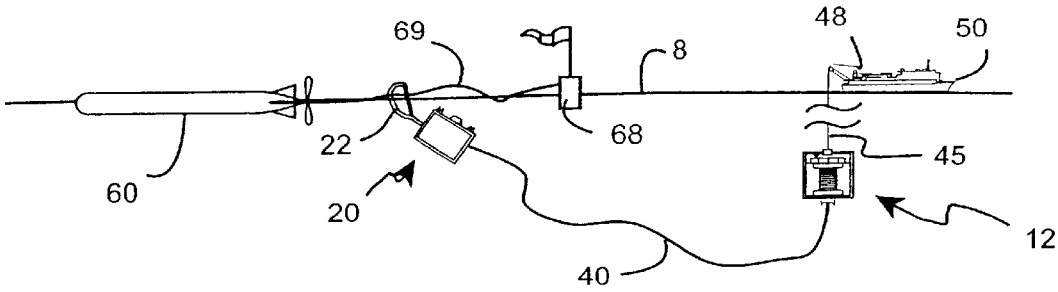
Figure 4E:
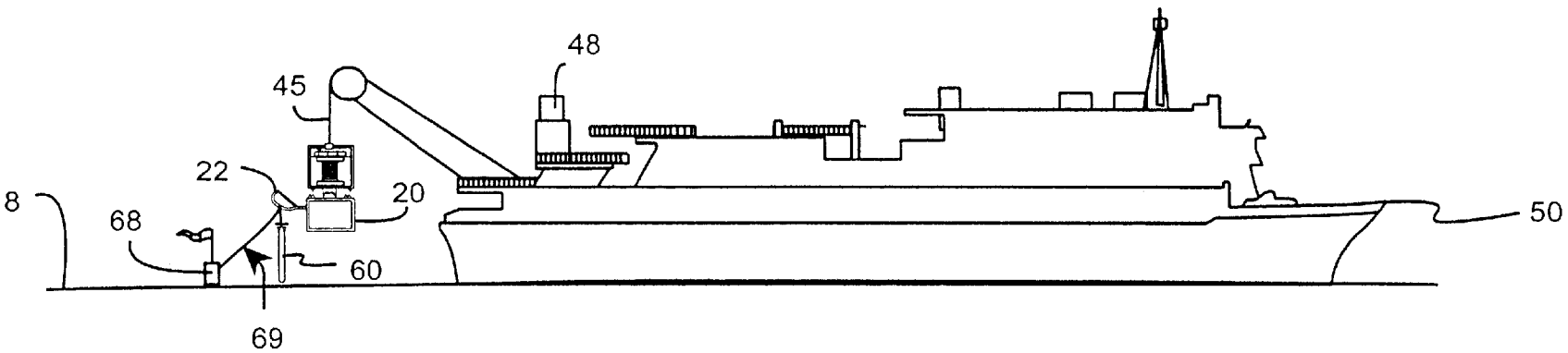

As illustrated in FIG. 4D, once flying latch vehicle 20 has engaged buoy line 69 (i.e., connector firmly grasps buoy line 69 such that attached AUV 60 can be moved without slipping), tether 40 is taken in by tether management system 12 and flying latch vehicle 20 (and attached AUV and buoy line 69) is moved adjacent to system 12 (with or without the assistance of propulsion means 28). As shown in FIG. 4E, line latch system 10 (and attached AUV and buoy line 69) can then be hauled to the surface of body of water 8 and placed on surface support vessel 50 using launching and recovery device 48 and umbilical 45. For example, device 48 can take the form of a crane which raises AUV 60 above the height of a deck on vessel 50, then swings horizontally to place AUV 60 over the deck, and then lowers AUV 60 onto the deck. As another example, a "moon pool" system could be used to recover AUV 60 from the surface of body of water 8 to a deck on vessel 50. In this manner, AUV 60 can be recovered.

Figure 5:
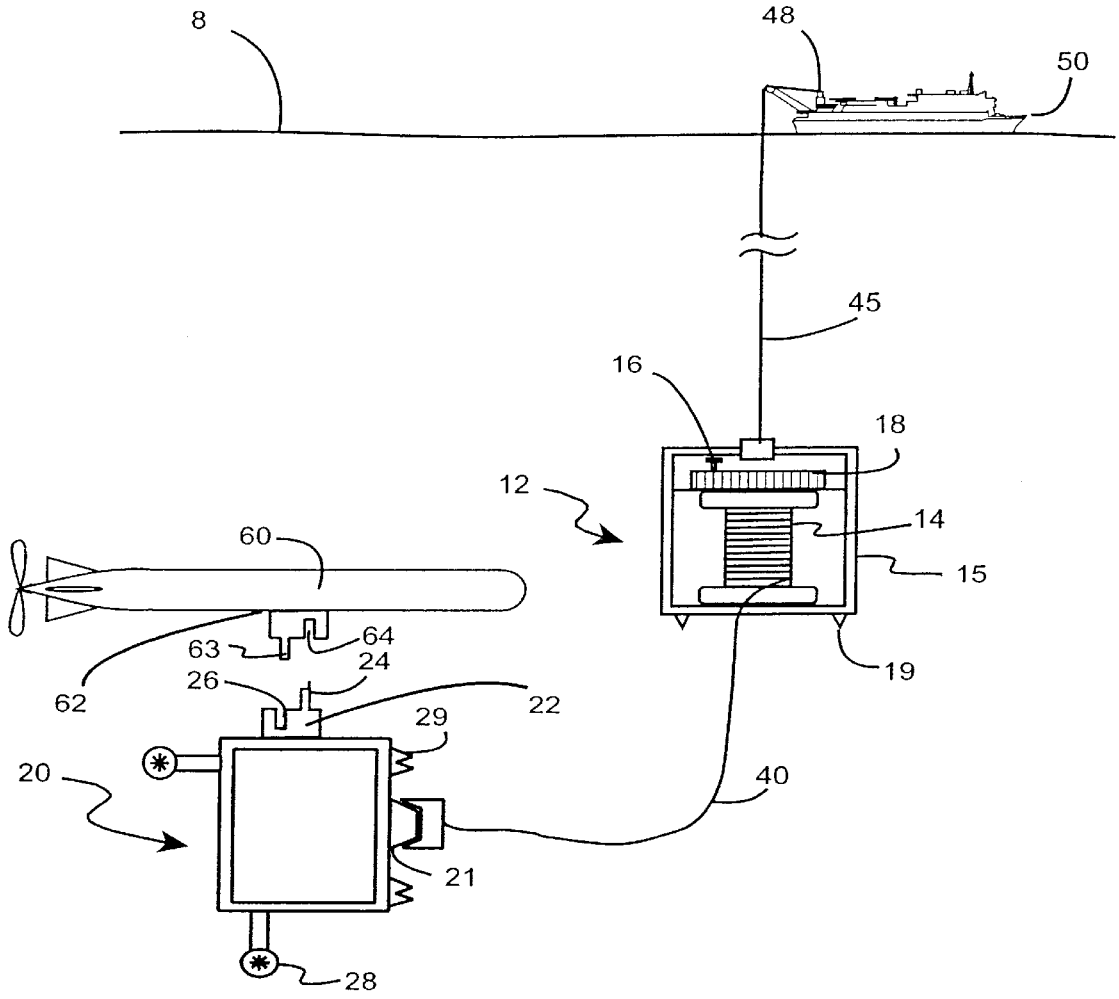
FIG. 5 is a schematic view of a linelatch system for recharging an autonomous underwater vehicle at a subsurface location shown just before docking with an autonomous underwater vehicle.

Referring now to FIG. 5, linelatch system 10 can also be used to transfer power and/or data between a device on sea surface (e.g., surface support vessel 50) and AUV 60. In this method, linelatch system 10 serves as a power and communications bridge (as well as a mechanical link) between surface support vessel 50 and AUV 60. In preferred embodiments, this method includes the steps of deploying linelatch system 10 from surface vessel 50 into body of water 8; placing linelatch system 10 in the open position; maneuvering flying latch vehicle 20 to AUV 60; aligning and mating vehicle 20 with AUV 60; transferring power and/or data between flying latch vehicle 20 and AUV 60, and detaching vehicle 20 from AUV 60.

As shown in FIG. 5, when outfitted with power output port 24 and two way communications port 26, linelatch system 10 can be lowered to a subsurface location to interface, provide power to, and exchange data with AUV 60 at a subsurface (shown) or surface location (not shown). Similarly to the operation shown in FIGS. 3A–3C, linelatch system 10 is lowered by umbilical 45 from surface support vehicle 50 using launching and recovery device 48. Linelatch system 10 is lowered until it reaches the approximate depth of AUV 60. Tether is then played out from the tether management system 12 and flying latch vehicle 20 flown away from system 12 toward AUV 60. When proximal to AUV 60, connector 22 engages receptor 62 so that flying latch vehicle 20 docks AUV 60 and establishes a power and data link between them.

Through this link, power transmitted from surface support vessel 50 can be transferred via linelatch system 10 to AUV 60. The power thus transferred to AUV 60 can be used to recharge a power source (e.g., a battery) on AUV 60 or run the power-consuming components of AUV independent of the on-board power supply (e.g., AUV 60's propulsion means 28 can be used to assist movement of AUV 60 to a recovery boat). In a like fashion, using this link, data can be transferred between surface support vessel 50 and AUV 60 through linelatch system 10. For example, data recorded from AUV 60's previous mission can be uploaded to vessel 50 and new mission instructions downloaded to AUV 60 from vessel 50. Using this method, AUV 60 can be repeatedly serviced so that it can perform several missions in a row without requiring recovery. The method avoids the problems associated with prior art methods of AUV recovery such as the potential for damage which may occur by the AUV striking the recovery vessel.

From the foregoing, it can be appreciated that the linelatch system of the invention facilitates deployment, recovery, servicing, and operation of AUVs.

While the above specification contains many specifics, these should not be construed as limitations on the scope of the invention, but rather as examples of preferred embodiments thereof. Many other variations are possible. For example, a manned linelatch system for servicing an AUV and undersea vehicles such as submarines having a linelatch system for servicing an AUV are included within the invention. Also within the invention are methods of servicing an AUV from a subsurface power and data module. These methods are similar to that shown in FIG. 5, except that linelatch system 10 is interposed between AUV 60 and the subsurface module rather than between an AUV and a surface support vessel. Accordingly, the scope of the invention should be determined not by the embodiments illustrated, but by the appended claims and their legal equivalents.

What is claimed is:

1. A method of retrieving an autonomous underwater vehicle (AUV) in a body of water from a vessel, said method comprising the steps of:

(a) positioning said AUV in a recovery location in a column of water defined between a water surface and a seabed;

(b) deploying a submersible system, the submersible system including:

a tether management system attached to the vessel, a submersible vehicle releasably connected to the tether management system, and a tether for communicating at least one of power data and materials between the submersible vehicle and the tether management system;

(c) releasing the submersible vehicle from the tether management system;

(d) remotely maneuvering the submersible vehicle to the AUV at said recovery location;

(e) connecting the submersible vehicle to the AUV;

(f) mating the submersible vehicle to the tether management system; and, (g) retrieving the submersible system and said AUV.

2. The method as recited in claim 1, further comprising the steps of providing sufficient slack in said tether to compensate for heaving of the vessel.

3. A method of retrieving an autonomous underwater vehicle (AUV) in a body of water from a vessel, said method comprising the steps of:

(a) deploying a submersible system, the submersible system including:

a tether management system attached to the vessel, a submersible vehicle releasably connected to the tether management system, the submersible vehicle having a connector, and a tether linking the submersible vehicle to the tether management system;

(b) releasing the submersible vehicle from the tether management system;

(c) remotely maneuvering the submersible vehicle to the AUV;

(d) connecting the connector of the submersible vehicle to a buoy line attached to the AUV;

(e) mating the submersible vehicle to the tether management system; and, (f) retrieving the submersible system.

4. The method as recited in claim 3, further comprising the step of providing sufficient slack in said tether to compensate for heaving of the vessel.

5. A method of servicing an autonomous underwater vehicle (AUV) in a body of water by communicating at least one of power, data, and materials between a vessel and the AUV, said method comprising the steps of:

(a) deploying a submersible system into the body of water, the submersible system comprising:

a tether management system attached to the vessel, a submersible vehicle releasably connected to the tether management system, the submersible vehicle having a connector, and a tether for communicating at least one of power data and materials between said AUV and said tether management system;

(b) remotely propelling the submersible vehicle towards the AUV;

(c) connecting the connector to the AUV;

(d) communicating the at least one of power, data, and materials between said vessel and the AUV; and, (e) detaching the connector from the AUV.

6. The method as recited in claim 5, further comprising the step of retrieving the submersible vehicle to said vessel.

7. The method as recited in claim 5, wherein said communicating step comprises the step of recharging the AUV with power.

8. The method as recited in claim 7, wherein during said recharging step, more that about 50% of the power transmitted to the submersible vehicle is transmitted to said AUV.

9. The method as recited in claim 5, wherein said communicating step comprises the step of downloading mission data from said AUV.

10. The method as recited in claim 9, where said communicating step further comprises the step of transferring the downloaded mission data to the vessel.

11. The method as recited in claim 5, wherein said communicating step further comprises the step of uploading mission instructions to the AUV.

12. The method as recited in claim 5, further comprising the step of providing sufficient slack in said tether to compensate for heaving of the vessel.

* * * * *